US010339915B2

(12) United States Patent
Logan

(10) Patent No.: US 10,339,915 B2
(45) Date of Patent: Jul. 2, 2019

(54) VIBRATION SPEAKER FOR AUDIO HEADSETS

(71) Applicant: Disney Enterprises, Inc., Burbank, CA (US)

(72) Inventor: David J. Logan, Lomita, CA (US)

(73) Assignee: Disney Enterprises, Inc., Burbank, CA (US)

( * ) Notice: Subject to any disclaimer, the term of this patent is extended or adjusted under 35 U.S.C. 154(b) by 153 days.

(21) Appl. No.: 14/920,619

(22) Filed: Oct. 22, 2015

(65) Prior Publication Data

US 2017/0116977 A1 Apr. 27, 2017

(51) Int. Cl.

| | |
|---|---|
| ***H04R 1/10*** | (2006.01) |
| ***G10K 11/24*** | (2006.01) |
| ***H04R 25/00*** | (2006.01) |
| ***B06B 1/04*** | (2006.01) |
| ***B06B 1/16*** | (2006.01) |
| ***H04R 5/033*** | (2006.01) |

(52) U.S. Cl.

CPC ..... *G10K 11/24* (2013.01); *B06B 1/045* (2013.01); *B06B 1/16* (2013.01); *H04R 1/1016* (2013.01); *H04R 5/033* (2013.01); *H04R 25/606* (2013.01); *H04R 2400/03* (2013.01); *H04R 2420/07* (2013.01); *H04R 2460/13* (2013.01); *H04S 2400/07* (2013.01)

(58) Field of Classification Search

CPC ..... H04R 2400/03; H04R 2499/11; H04R 2460/13; H04R 25/606; H04R 1/10; H04R 1/1008; H04R 1/1058; H04R 1/1091; H04R 2420/07; H04R 1/1016; H04R 9/066; H04M 19/047; G10K 11/00; G10K 11/18; G10K 11/24; B06B 1/045

USPC ..... 381/150–152, 161, 162, 309, 326, 370, 381/374, 380, 381, 396

See application file for complete search history.

(56) References Cited

U.S. PATENT DOCUMENTS

| | | | | |
|---|---|---|---|---|
| 5,524,061 | A * | 6/1996 | Mooney | G08B 6/00 381/151 |
| 8,767,996 | B1 * | 7/2014 | Lin | H04R 1/1091 381/370 |
| 2008/0112581 | A1 * | 5/2008 | Kim | H04R 1/1075 381/151 |
| 2011/0264491 | A1 * | 10/2011 | Birnbaum | G06F 3/016 705/14.4 |
| 2013/0324047 | A1 * | 12/2013 | Wells | H04R 5/033 455/41.3 |
| 2014/0267076 | A1 * | 9/2014 | Birnbaum | B25J 13/025 345/173 |
| 2015/0016638 | A1 * | 1/2015 | Hebenstreit | H04R 1/028 381/151 |
| 2017/0053654 | A1 * | 2/2017 | Lacroix | G06F 3/016 |
| 2017/0055055 | A1 * | 2/2017 | Albanese | H04R 1/028 |

* cited by examiner

*Primary Examiner* — Huyen D Le
(74) *Attorney, Agent, or Firm* — Farjami & Farjami LLP

(57) ABSTRACT

There are provided audio headsets including one or more vibration speakers. Each vibration speaker includes a haptic driver and a haptic actuator for generating physical vibrations based on an audio input to the vibration speaker. In addition, each vibration speaker includes a rigid output surface designed to make physical contact with a user of the audio headset. The haptic actuator is designed to transfer the physical vibrations generated by the vibration speaker to the user via the rigid output surface.

16 Claims, 5 Drawing Sheets

VIBRATION SPEAKER FOR AUDIO HEADSETS

BACKGROUND

Audio speakers used in headphones and headsets have historically been designed to fit on or in the outer ear so as to conduct sound into the inner ear via the ear canal and ear drum. More recently, alternative approaches to conducting sound into the inner ear have been developed. For example, so called bone conduction headphones are designed to transmit sound into the inner ear via the skull, rather than through the outer ear.

Bone conduction audio technology is growing in popularity due in part to its enhanced safety when used in environments in which interference with ambient sounds is undesirable, such as when a user is driving an automobile or exercising in a public space. However, the emphasis by many manufacturers on providing high fidelity bone conduction audio products has resulted in the cost of such products being undesirably high, particularly for applications in which lower fidelity audio performance is satisfactory.

SUMMARY

There are provided vibration speakers for audio headsets, substantially as shown in and/or described in connection with at least one of the figures, and as set forth more completely in the claims.

DETAILED DESCRIPTION

Figure 1:
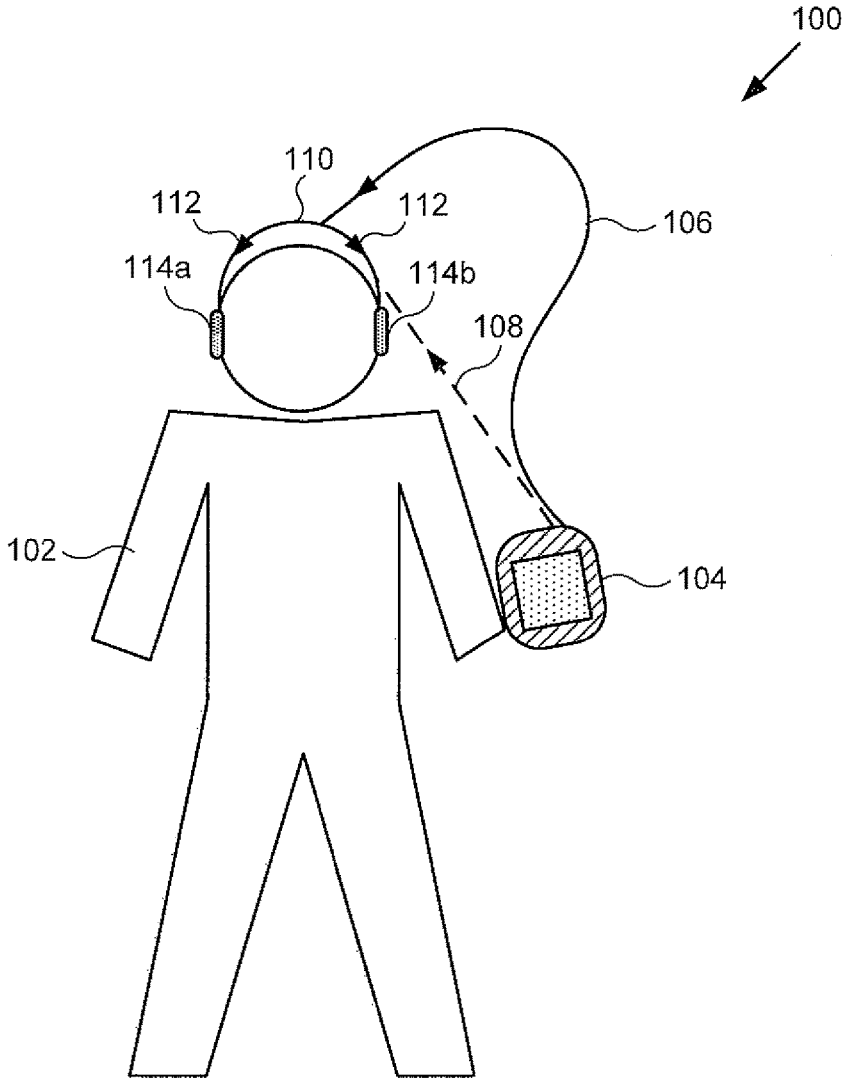
FIG. 1 shows an exemplary audio headset including vibration speakers, according to one implementation.

The following description contains specific information pertaining to implementations in the present disclosure. One skilled in the art will recognize that the present disclosure may be implemented in a manner different from that specifically discussed herein. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 shows an exemplary audio headset including vibration speakers, according to one implementation. Audio use environment 100 in FIG. 1 includes user 102, portable audio device 104, and audio headset 110 including vibration speakers 114*a* and 114*b*. As shown in FIG. 1, vibration speakers 114*a* and 114*b* receive audio inputs 112 via audio headset 110. As further shown in FIG. 1, audio headset 110 may be a wired or wireless audio headset, as indicated by alternative wired connection 106 and wireless connection 108 enabling communication between portable audio device 104 and audio headset 110.

It is noted that, as used in the present application, the term "audio headset" may refer to a feature including one or more vibration speakers corresponding to vibration speakers 114*a* and 114*b*. Moreover, an audio headset, as used herein, may refer to a feature including or omitting a microphone for use by user 102. Thus, in some implementations, audio headset 110 may take the form of an audio earphone or audio headphones designed simply to receive audio, while in other implementations, audio headset 110 may be a two-way communication device.

It is further noted that vibration speakers 114*a* and 114*b* are configured to make physical contact with user 102. For example, vibration speakers 114*a* and 114*b* may be bone conduction speakers designed to transmit audio input 112 to user 102 in the form of physical vibrations via the bones of the user's skull. In one implementation, for instance, vibration speakers 114*a* and 114*b* may make contact with an outer surface of the head of user 102 adjacent, such as in front of, the user's ears, in the region of the upper jaw or cheek of user 102. However, in another exemplary implementation, vibration speakers 114*a* and 114*b* may be clipped or otherwise attached to the outer ears of user 102 so as to produce physical vibrations in the structure of the outer ears of user 102.

Figure 2:
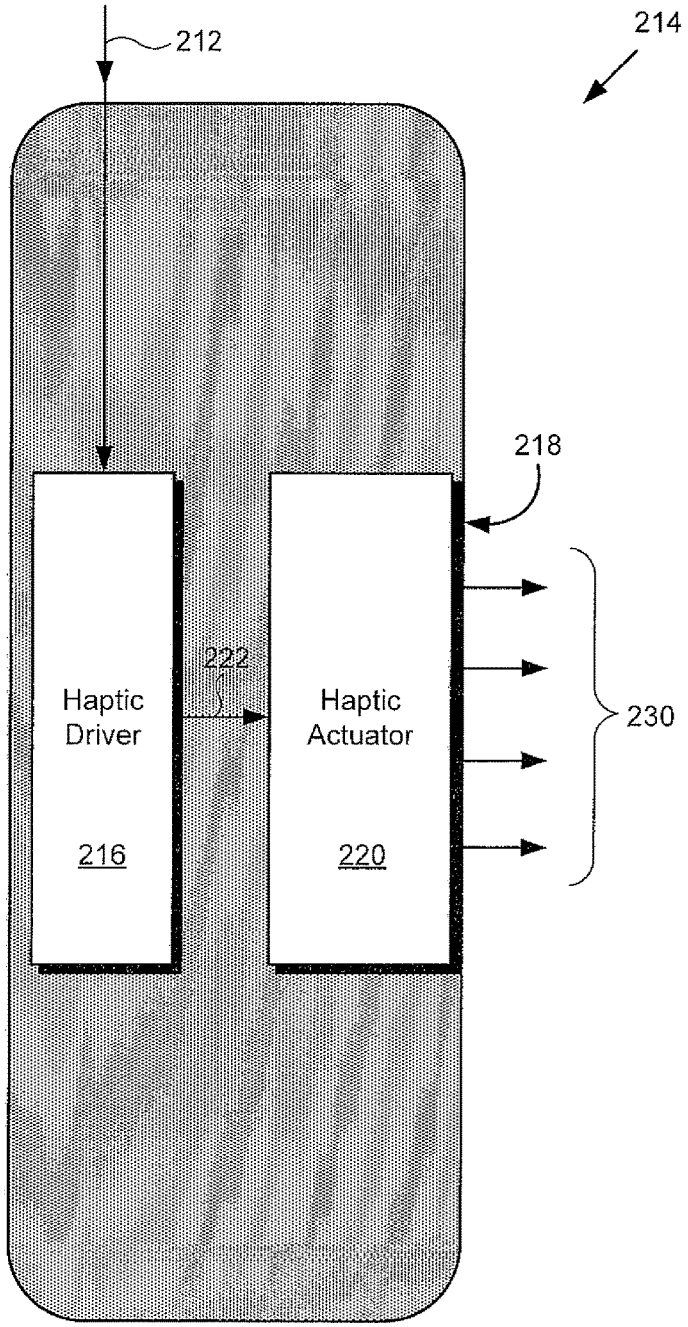
FIG. 2 shows a more detailed representation of an exemplary vibration speaker suitable for use in an audio headset, according to one implementation.

Referring to FIG. 2, FIG. 2 shows a more detailed representation of an exemplary vibration speaker suitable for use in an audio headset, according to one implementation. As shown in FIG. 2, vibration speaker 214 includes haptic driver 216 and haptic actuator 220 driven by haptic driver 216. As further shown in FIG. 2, vibration speaker 214 receives audio input 212 and produces physical vibrations 230 as an output at rigid output surface 218 of vibration speaker 214. Vibration speaker 214 receiving audio input 212 and producing physical vibrations 230 corresponds in general to vibration speaker 114*a* and/or vibration speaker 114*b* receiving audio input 112, in FIG. 1, and may share any of the characteristics attributed to those corresponding features in the present application.

Audio input 212 may correspond to music or speech, for example. Haptic driver 216 includes circuitry for transforming audio input 212 into drive signals 222 for producing physical vibrations 230 at rigid output surface 218 of vibration speaker 214, using haptic actuator 220. Rigid output surface 218 of vibration speaker 214 is designed for physical contact with a user of vibration speaker 214, such as user 102, in FIG. 1. For example, vibration speaker 214 may be a bone conduction speaker designed to transmit audio input 212 to a user in the form of physical vibrations 230 via the bones of the user's skull. In one exemplary implementation, rigid output surface 218 of vibration speaker 214 may make contact with a users head, external to and adjacent the user's ears, such as in the region of the upper jaw or cheek of the user, for example.

Haptic actuator 220 is designed to mechanically generate and transfer physical vibrations 230 to rigid output surface 218 of vibration speaker 214. As discussed in greater detail by reference to FIGS. 3, 4, and 5, below, haptic actuator 220 can take several exemplary forms. For example, haptic actuator 220 may be implemented as a motor driven mechanism, such as a rotating mass or a magnetically driven spring, or as a piezoelectric element designed to flex in response to a voltage applied across the piezoelectric element.

Figure 3:
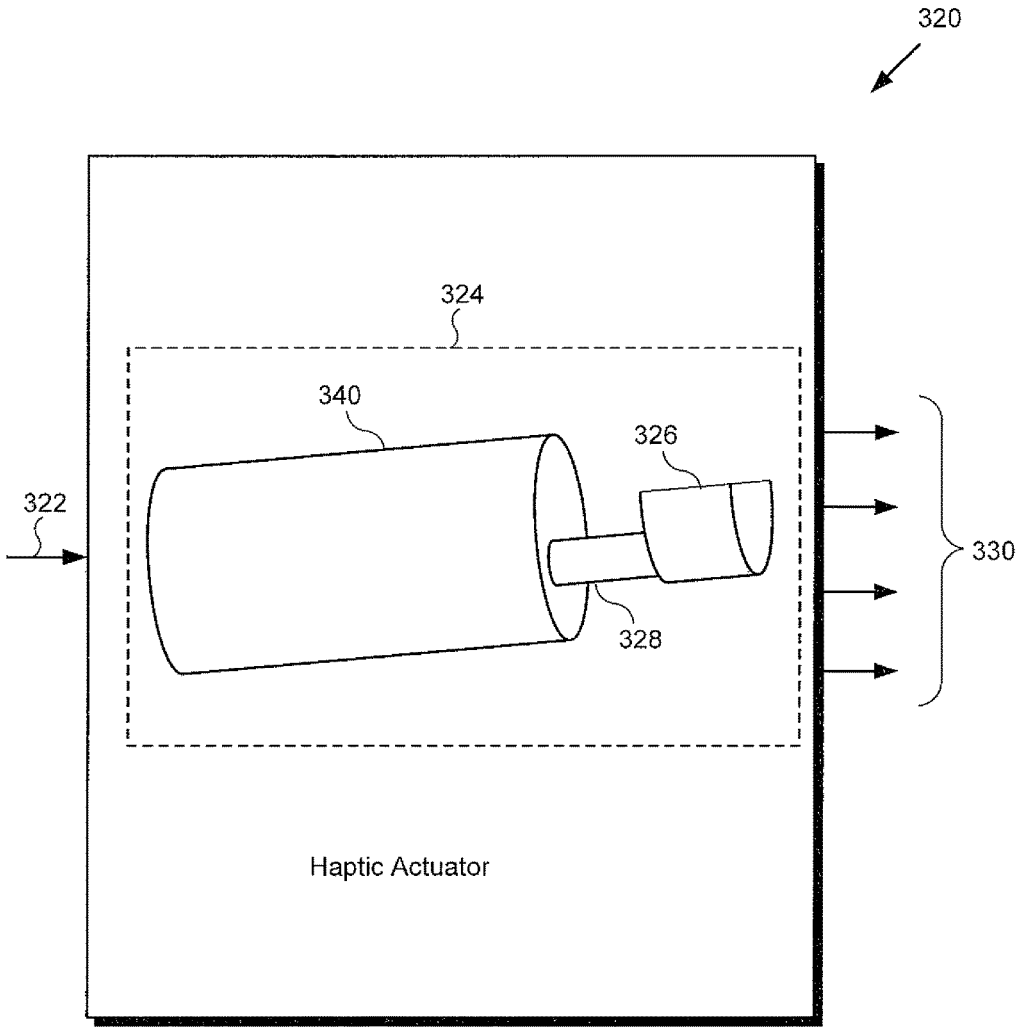
FIG. 3 shows an exemplary haptic actuator for use in a vibration speaker, according to one implementation.

Continuing to FIG. 3, FIG. 3 shows an exemplary haptic actuator for use in a vibration speaker, according to one implementation. As shown in FIG. 3, haptic actuator 320 includes eccentric rotating mass (ERM) 324 having motor 340, shaft 328, and mass 326. Also shown in FIG. 3 are drive signals 322 received by haptic actuator 320 from a haptic driver corresponding to haptic driver 216, in FIG. 2, as well as physical vibrations 330 generated by haptic actuator 320. Haptic Actuator 320 receiving drive signals 322 and generating physical vibrations 330 corresponds in general to haptic actuator 220 receiving drive signals 222 and generating physical vibrations 230, in FIG. 2, and may share any of the characteristics attributed to that corresponding feature in the present application.

With respect to the specific implementation shown in FIG. 3, motor 340 is designed to rotate mass 326, which is an off-center or asymmetrical mass, in response to drive signals 322, using shaft 328. The rotation of off-center or asymmetrical mass 326 generates vibrations that are transferred to rigid output surface 218 of vibration speaker 214 by haptic actuator 220/320, resulting in physical vibrations 230/330 being produced by vibration speaker 214.

It is noted that haptic actuator 320 including ERM 324 can enable implementation of vibration speaker 214 at a substantially reduced cost when compared with high fidelity bone conduction speakers presently available to consumers. As a result, vibration speakers 114*a*/114*b*/214 having haptic actuator 320 implemented so as to include ERM 324 can advantageously provide the enhanced safety associated with use of conventional bone conduction speakers at lower cost, for use cases in which lower fidelity audio output is satisfactory.

Figure 4:
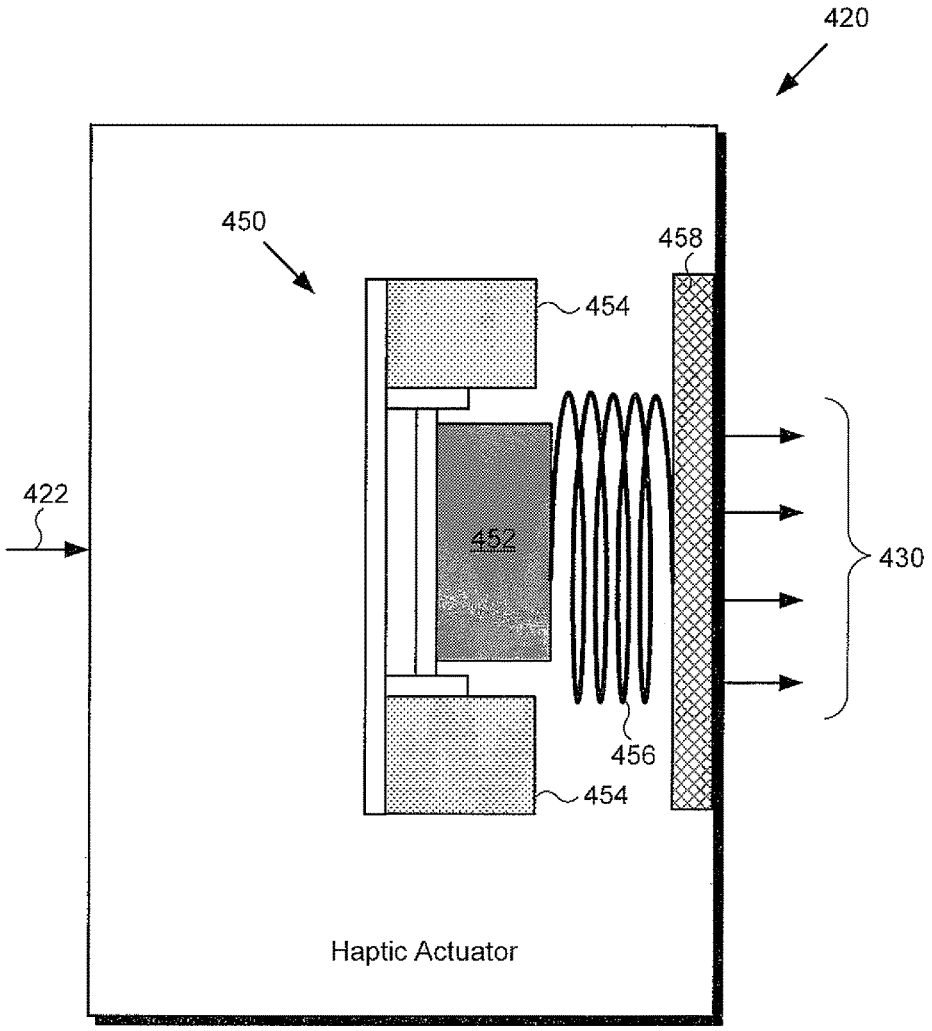
FIG. 4 shows an exemplary haptic actuator for use in a vibration speaker, according to another implementation.

Moving to FIG. 4, FIG. 4 shows an exemplary haptic actuator for use in a vibration speaker, according to another implementation. As shown in FIG. 4, haptic actuator 420 includes linear resonant actuator (LRA) 450 for transferring the physical vibrations generated by vibration speaker 114*a*/114*b*/214 to rigid output surface 218. As further shown in FIG. 4, LRA 450 includes magnet 452 surrounded by coil 454 and attached to spring 456.

Also shown in FIG. 4 are vibration plate 458, drive signals 422 received by haptic actuator 420 from a haptic driver corresponding to haptic driver 216, in FIG. 2, and physical vibrations 430 generated by haptic actuator 420. Haptic Actuator 420 receiving drive signals 422 and generating physical vibrations 430 corresponds in general to haptic actuator 220 receiving drive signals 222 and generating physical vibrations 230, in FIG. 2, and may share any of the characteristics attributed to that corresponding feature in the present application.

Regarding the specific implementation shown in FIG. 4, LRA 450 is designed to use magnet 452 to drive spring 456, in response to drive signals 422. The compression and relaxation or stretching of spring 456, in turn, causes vibration plate 458 to generate vibrations that are transferred to rigid output surface 218 of vibration speaker 214 by haptic actuator 220/420, resulting in physical vibrations 230/430 being produced by vibration speaker 214.

It is noted that haptic actuator 420 including LRA 450 can enable implementation of vibration speaker 214 at a reduced cost when compared with high fidelity bone conduction speakers presently available to consumers. As a result, vibration speakers 114*a*/114*b*/214 having haptic actuator 420 implemented so as to include LRA 450 can advantageously provide the enhanced safety associated with use of conventional bone conduction speakers at lower cost, for use cases in which lower fidelity audio output is satisfactory.

Figure 5:
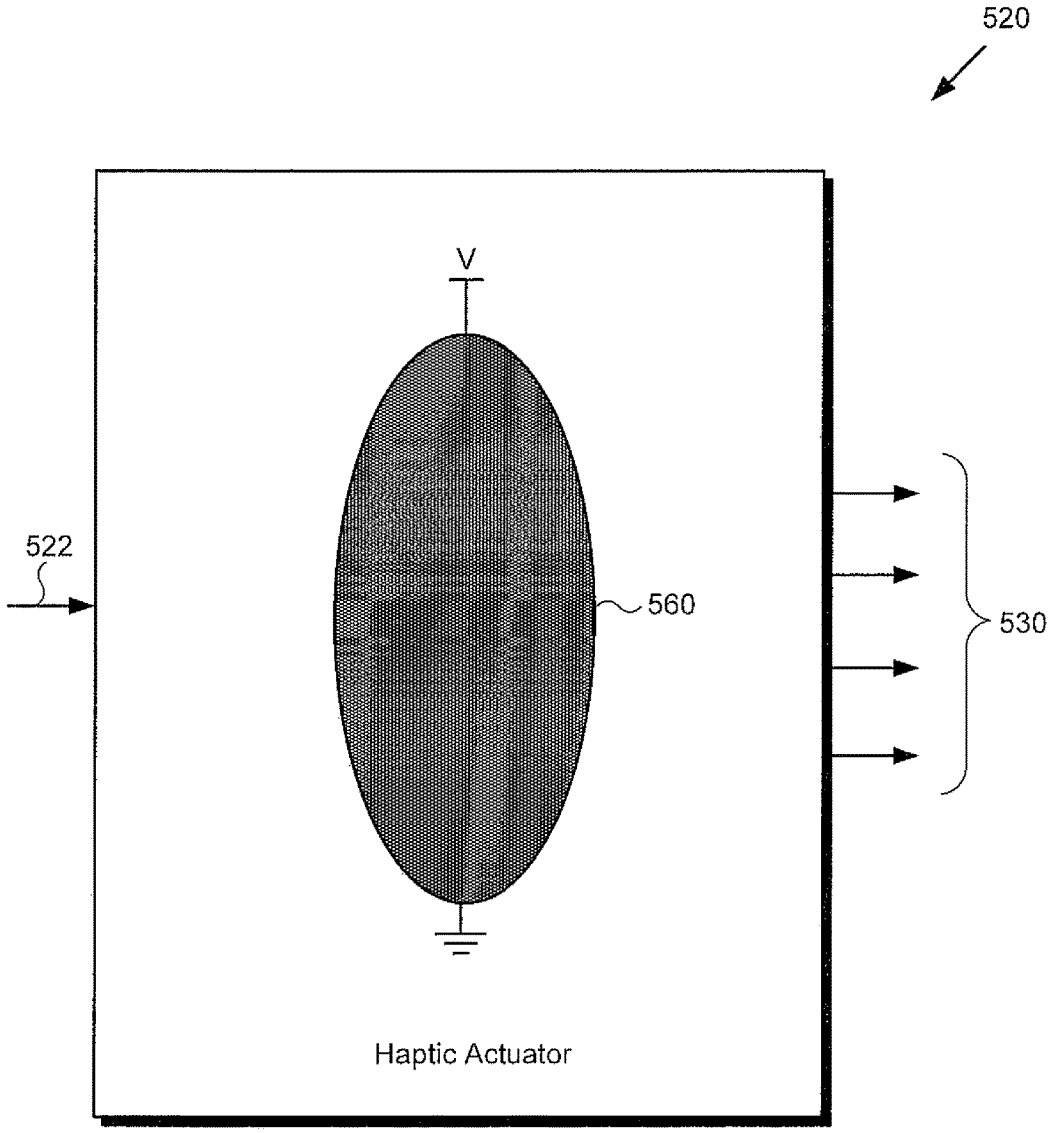
FIG. 5 shows an exemplary haptic actuator for use in a vibration speaker, according to yet another implementation.

Referring now to FIG. 5, FIG. 5 shows an exemplary haptic actuator for use in a vibration speaker, according to yet another implementation. As shown in FIG. 5, haptic actuator 520 includes piezoelectric element 560 for transferring the physical vibrations generated by vibration speaker 114*a*/114*b*/214 to rigid output surface 218. Also shown in FIG. 5 are the voltage across piezoelectric element 560, i.e., voltage V and ground potential, drive signals 522 received by haptic actuator 520 from a haptic driver corresponding to haptic driver 216, in FIG. 2, and physical vibrations 530 generated by haptic actuator 520. Haptic Actuator 520 receiving drive signals 522 and generating physical vibrations 530 corresponds in general to haptic actuator 220 receiving drive signals 222 and generating physical vibrations 230, in FIG. 2, and may share any of the characteristics attributed to that corresponding feature in the present application.

According to the exemplary implementation shown in FIG. 5, piezoelectric element 560 is designed to flex or vibrate due to changes in applied voltage V produced by drive signals 522. Piezoelectric element 560 may be implemented as a disc, a plate, or a strip, for example. The flexing forces or vibrations of piezoelectric element 560 are transferred to rigid output surface 218 of vibration speaker 214 by haptic actuator 220/520, resulting in physical vibrations 230/530 being produced by vibration speaker 214.

Like haptic actuators 320 and 420 in respective FIGS. 3 and 4, haptic actuator 520 including piezoelectric element 560, in FIG. 5, can enable implementation of vibration speaker 214 at a reduced cost when compared with high fidelity bone conduction speakers now available to consumers. As a result, vibration speakers 114*a*/114*b*/214 having haptic actuator 520 implemented so as to include piezoelectric element 560 can advantageously provide the enhanced safety associated with use of conventional bone conduction speakers at lower cost, for use cases in which lower fidelity audio output is satisfactory.

Thus, the present application discloses implementations of a vibration speaker and an audio headset including such a speaker that advantageously provide a low cost alternative to expensive high fidelity bone conduction audio products presently available to consumers. By utilizing a haptic driver and relatively inexpensive haptic actuator technologies to transfer physical vibrations to a rigid output surface of a vibration speaker, the implementations disclosed in the present application can provide the safety advantages of conventional bone conduction speakers at lower cost.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described herein, but many rearrangements, modifications, and substitutions are possible without departing from the scope of the present disclosure.

What is claimed is:

1. An audio headset comprising:

at least one vibration speaker including a haptic driver and a haptic actuator for generating physical vibrations based on an audio input to the at least one vibration speaker;

a rigid output surface of the at least one vibration speaker configured for physical contact with a user of the audio headset;

wherein the haptic actuator is further configured to transfer the physical vibrations generated by the at least one vibration speaker to the rigid output surface;

wherein the at least one vibration speaker is configured as a bone conduction speaker designed to transmit the audio input to an inner ear of a user of the audio headset in the foil of physical vibrations via a cheek or a jaw of the user, and wherein the haptic actuator comprises a spring for transferring the physical vibrations generated by the at least one vibration speaker to the rigid output surface.

2. The audio headset of claim 1, wherein the haptic actuator comprises a motor.

3. The audio headset of claim 1, wherein the haptic actuator comprises an eccentric rotating mass (ERM).

4. The audio headset of claim 1, wherein the haptic actuator comprises a linear resonant actuator (LRA) for transferring the physical vibrations generated by the at least one vibration speaker to the rigid output surface.

5. The audio headset of claim 1, wherein the haptic actuator comprises a piezoelectric element for transferring the physical vibrations generated by the at least one vibration speaker to the rigid output surface.

6. The audio headset of claim 1, wherein the audio headset includes two vibration speakers.

7. The audio headset of claim 1, wherein the audio headset is a wired audio headset.

8. The audio headset of claim 1, wherein the audio headset is a wireless audio headset.

9. The audio headset of claim 1, wherein the haptic driver is configured to transform the audio input into drive signals for producing the physical vibrations at the rigid output surface.

10. A vibration speaker for use in an audio headset, the vibration speaker comprising:

a haptic driver and a haptic actuator for generating physical vibrations based on an audio input to the vibration speaker;

a rigid output surface configured for physical contact with a user of the vibration speaker;

wherein the haptic actuator is further configured to transfer the physical vibrations generated by the vibration speaker to the rigid output surface;

wherein the at least one vibration speaker is configured as a bone conduction speaker designed to transmit the audio input to an inner ear of a user of the audio headset in the form of physical vibrations via a cheek or a jaw of the user, and wherein the haptic actuator comprises a spring for transferring the physical vibrations generated by the at least one vibration speaker to the rigid output surface.

11. The vibration speaker of claim 10, wherein the haptic actuator comprises a motor.

12. The vibration speaker of claim 10, wherein the haptic actuator comprises an eccentric rotating mass (ERM).

13. The vibration speaker of claim 10, wherein the haptic actuator comprises a linear resonant actuator (LRA) for transferring the physical vibrations generated by the vibration speaker to the rigid output surface.

14. The vibration speaker of claim 10, wherein the haptic actuator comprises a piezoelectric element for transferring the physical vibrations generated by the vibration speaker to the rigid output surface.

15. The vibration speaker of claim 10, wherein the vibration speaker is one of two vibration speakers included as components of the audio headset.

16. The vibration speaker of claim 10, wherein the haptic driver is configured to transform the audio input into drive signals for producing the physical vibrations at the rigid output surface.

* * * * *